US007621018B2

(12) United States Patent
Libhart

(10) Patent No.: US 7,621,018 B2
(45) Date of Patent: Nov. 24, 2009

(54) ROAD/PAVEMENT CLEANING MACHINE HAVING AIR-BLAST FUNCTIONALITY

(75) Inventor: Anthony Libhart, Huntsville, AL (US)

(73) Assignee: Schwarze Industries, Inc., Huntsville, AL (US)

( * ) Notice: Subject to any disclaimer, the term of this patent is extended or adjusted under 35 U.S.C. 154(b) by 550 days.

(21) Appl. No.: 11/098,392

(22) Filed: Apr. 5, 2005

(65) Prior Publication Data

US 2005/0217064 A1 Oct. 6, 2005

Related U.S. Application Data

(60) Provisional application No. 60/559,423, filed on Apr. 6, 2004.

(51) Int. Cl.
*E01H 1/08* (2006.01)

(52) U.S. Cl. ..... 15/340.1; 15/340.3; 15/340.4

(58) Field of Classification Search ..... 15/340.1, 15/340.3, 340.4, 328, 330, 405, 419, 345, 15/346, 331, 334
See application file for complete search history.

(56) References Cited

U.S. PATENT DOCUMENTS 3,491,399 A * 1/1970 Burgoon et al. ..... 15/328
4,858,270 A * 8/1989 Boschung ..... 15/328
5,107,566 A * 4/1992 Schmid ..... 15/405
5,477,585 A * 12/1995 Hentzschel et al. ..... 15/330
5,852,847 A * 12/1998 Weiss et al. ..... 15/346
5,884,359 A * 3/1999 Libhart ..... 15/346
6,000,095 A * 12/1999 Johnson ..... 15/405
6,371,565 B1 * 4/2002 Libhart ..... 15/83

* cited by examiner

*Primary Examiner*—Joseph J Hail, III
*Assistant Examiner*—Shantese McDonald
(74) *Attorney, Agent, or Firm*—Wallace G. Walter

(57) ABSTRACT

A road/pavement sweeper is provided with a pickup head or debris-intake hood that operates in a conventional manner to entrain or aspirate particles and/or debris from the pavement surface. The air-inlet structure of the debris-intake hood is provided with an air-flow control member that selectively directs the air flow through the debris-intake hood in order to conventionally entrain debris or particles from the surface being swept or through an opening in the side of the air-inlet structure to create an air blast useful to blow debris from the pavement or roadway surface. One or more fixed-position or controlled-position air flow vanes can be provided to selectively direct the air blast.

12 Claims, 8 Drawing Sheets

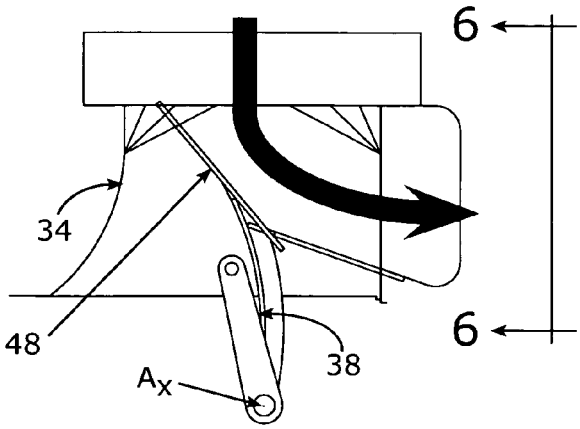
FIG. 5
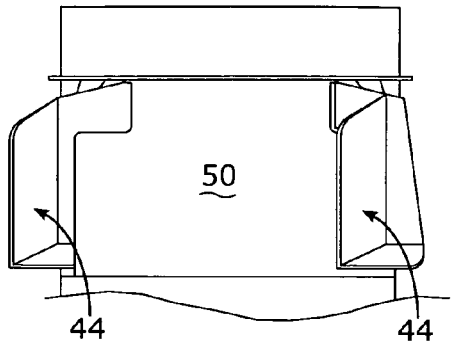
FIG. 6
FIG. 7
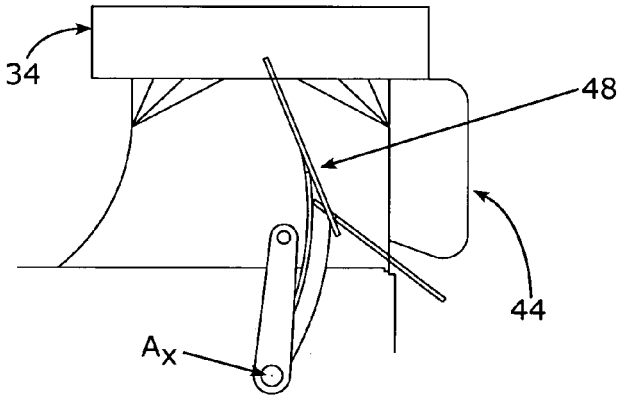
FIG. 8
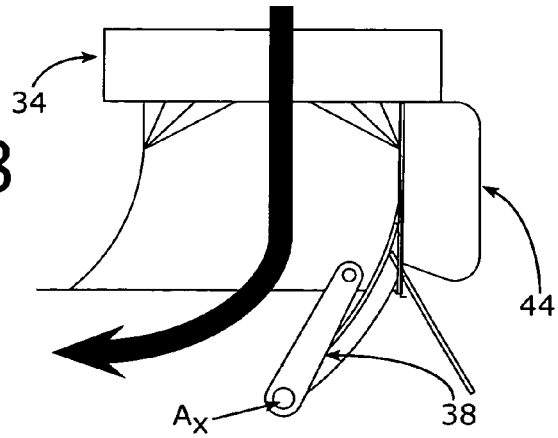

ROAD/PAVEMENT CLEANING MACHINE HAVING AIR-BLAST FUNCTIONALITY

REFERENCE TO EARLIER FILED APPLICATION

This application claims the benefit of earlier filed provisional patent application 60/559,423 filed Apr. 6, 2004 by the applicant herein.

BACKGROUND OF THE INVENTION

The present invention relates generally to road or pavement sweeping machines and, more particularly, to such machines having debris-intake hoods of the type designed to pickup or remove dust, particulates, and other debris from a road or pavement surface.

Various types of vehicles have been developed to sweep or vacuum debris from pavements, roadways, and streets. In general, these vehicles use a motor-driven fan to create a high-velocity air flow to effectively vacuum or aspirate the debris from the pavement or street surface. In a typical recirculating air-flow system, a motor-driven fan develops a high-volume, high-velocity air-flow through a debris-intake hood that is mounted closely adjacent the pavement surface. As the high-velocity air flow moves from an air-inflow portion of the debris-intake hood to an air-outflow portion, debris is aspirated by or entrained into the air flow. The debris-carrying air flow is then carried by ducting into and through a debris-collecting hopper or container. A gutter broom is often mounted adjacent to one or both lateral sides of the debris-intake hood to brush debris into the path of the debris-intake hood, and, additionally, a laterally extending cylindrical brush roll can be used to further dislodge debris from the surface being swept.

It is oftentimes desirable not to collect debris from the road or pavement surface but to blow the debris off the surface; for example, when cleaning an airport runway or waterfront pier of new-fallen snow, it may be more convenient to merely blow the snow onto ground surfaces adjacent the runway or into the water surrounding the pier.

SUMMARY OF THE INVENTION

A road/pavement sweeper is provided with a pickup head or debris-intake hood that operates in a conventional manner to entrain or aspirate particles and/or debris from the pavement surface. The air-inlet structure of the debris-intake hood is provided with an air-flow control member that selectively directs the air flow through the debris-intake hood or through an opening in the air-inlet structure to create an air blast useful to blow debris from the pavement or roadway surface. In one form of the invention, fixed-position air-flow vanes direct the air blast in a preferred direction, and, in other forms of the invention, one or more variable or controllable-position air-flow vanes allow the operator to selectively and variable direct the air-blast direction.

The full scope of applicability of the present invention will become apparent from the detailed description to follow, taken in conjunction with the accompanying drawings, in which like parts are designated by like reference characters.

BRIEF DESCRIPTION OF THE DRAWING

FIG. 5 is a detailed side elevational view, in partial cross-section, of the inlet structure of the debris-intake hood of FIGS. 2 and 3 showing an air flow control structure in an "air blast" mode;

FIG. 6 is another side elevational view of the inlet structure of FIG. 5, taken along line 6-6 of FIG. 5, showing an air-blast outlet opening;

FIG. 7 is a detailed side elevational view, in partial cross-section, of the inlet structure of the debris-intake hood of FIG. 5 showing the air flow control structure in an intermediate position;

FIG. 8 is a detailed side elevational view, in partial cross-section, of the inlet structure of the debris-intake hood of FIG. 5 showing the air flow control structure in a "pickup" mode;

DESCRIPTION OF THE INVENTION

Figure 1:
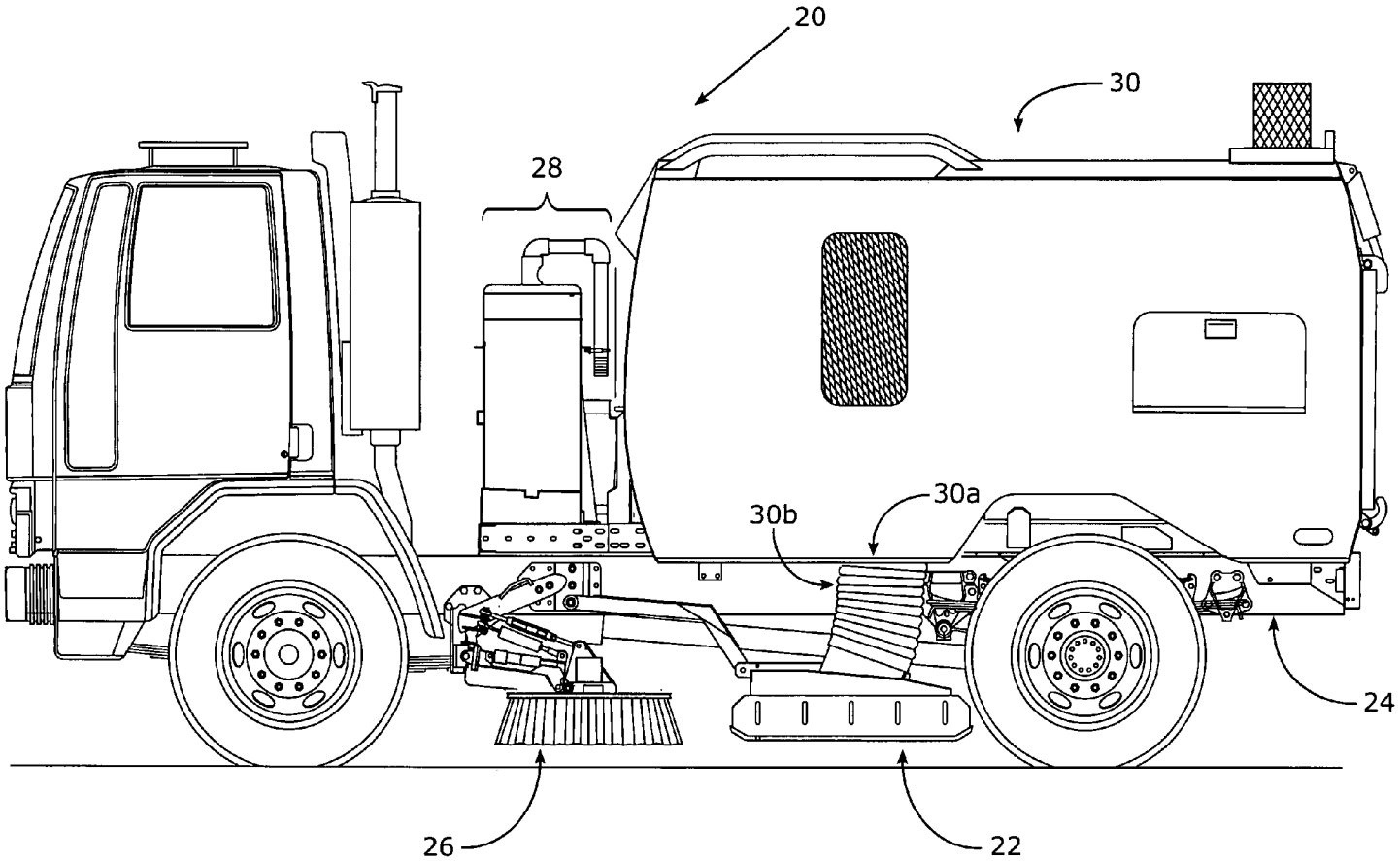
FIG. 1 is a partial side elevational view of a representative pavement/street sweeper having a debris-intake hood with a side or lateral air blast/blower system in accordance with the present invention.

An exemplary pavement/street sweeper upon which a debris-intake hood in accordance with the preferred embodiment can be mounted is shown in representative form in a truck-mounted sweeper 20 in side view in FIG. 1; the particular sweeper shown is exemplary and representative of sweepers manufactured by Schwarze Industries, Inc. of Huntsville, Ala. 35811.

As shown in FIG. 1, the truck-mounted sweeper 20, which can be fabricated from a commercial truck chassis, includes a pickup head or debris-intake hood 22 carried beneath the truck frame 24, a conventional gutter broom 26 that is mounted forwardly of the debris-intake hood 22 on one or both sides thereof, and a power unit 28 that includes (not specifically shown) a high-volume, high-velocity radial flow fan, an internal combustion engine for driving the fan and associated hydraulic pumps and various accessory and related equipment as is known in the art.

A debris container 30 is mounted rearwardly of the power unit 28 and is designed to receive and accumulate debris that is aspirated or swept from the roadway surface. The debris container 30 typically includes an inlet (not shown) into which the debris-laden air is conducted into the container 30 and an outlet 30*a* through which the air flow is returned in an air flow recirculation loop as is known in the art. Air handling flexhoses (of which flexhose 30*b* is shown in FIG. 1) interconnect the debris intake hood 22 with the debris container 30 as is also known in the art. The debris-laden air, as it enters the internal volume of the debris container 30, experiences a decrease in its air velocity so that the entrained particles "drop-out" of the air flow and are collected in the debris container 30. The air flow within and through the debris container 30 can be directed through various baffles and/or screens to maximize the probability the debris will be collected in the debris container 30. A more detailed description of the vehicle shown in FIG. 1 is provided in commonly assigned U.S. Pat. No. 6,371,565 issued Apr. 16, 2002 to A. Libhart, the disclosure of which is incorporated herein.

Figure 2:
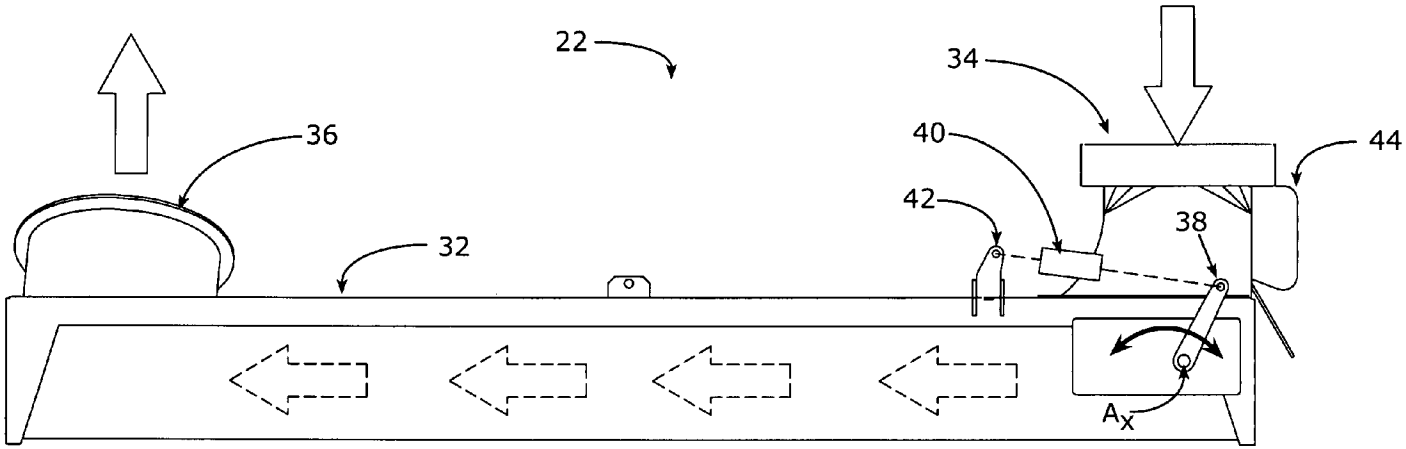
FIGS. 2 and 3 are side-to-side lengthwise views of a debris-intake hood showing air flow arrows for a first pickup mode in FIG. 2 and for a second air blast mode in FIG. 3.
Figure 3:
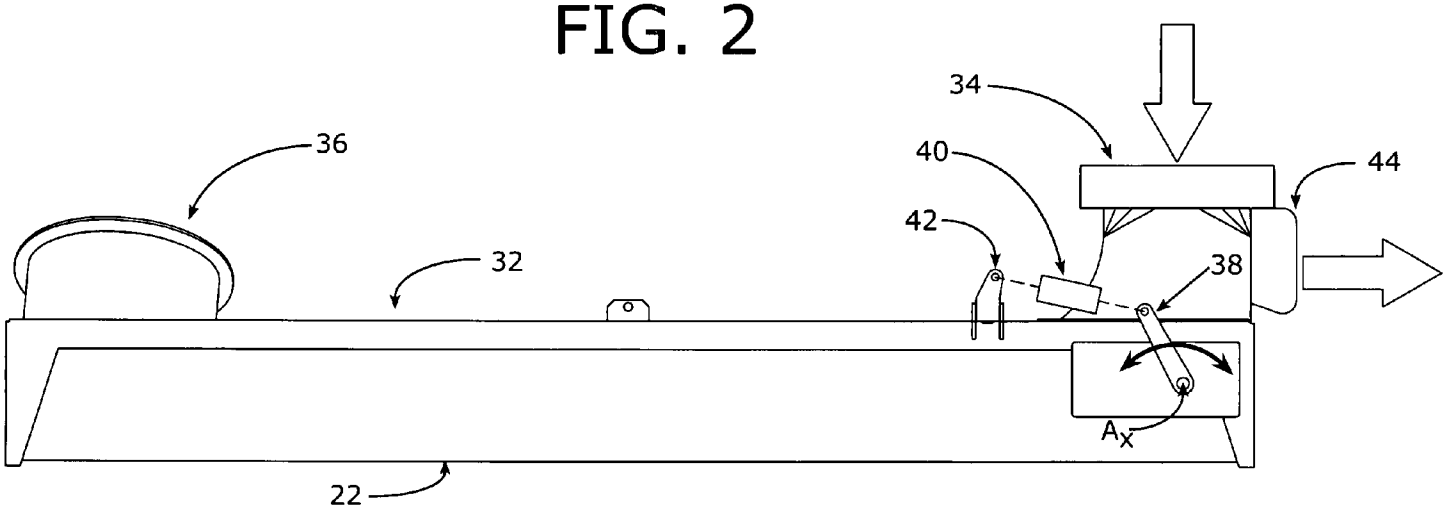

FIGS. 2 and 3 are a side-to-side lateral elevational view of the debris-intake hood 22 of FIG. 1 illustrating the air-flow pattern for the conventional pickup mode (FIG. 2) and the air blast mode (FIG. 3). As shown, the debris-intake hood 22 includes a housing 32 that is typically open on the side thereof facing the ground surface to be swept. An air-flow inlet structure 34 is provided on the right side of the housing 32 into which a high-volume, high-velocity flow of air enters the housing 32. In a similar manner, an air-flow outlet 36 structure is provided on the opposite end thereof from which the air-flow exits the housing 32. As is known in the art, the air-flow inlet and outlet structures connect to the vehicle air-flow recirculation system via flexible ducting (of which flexhose 30*b* of FIG. 1 is representative).

A pivotally mounted control arm 38 is provided on the right side of the housing 32 and is designed to be pivoted about an axis $A_x$ between a first position, as shown in FIG. 2, and a second position, as shown in FIG. 3. The control arm 38 is selectively moveable to and from its first and second position by an actuator 40 connected between the remote end of the control arm 38 and a suitable anchor point 42. The actuator 40 can take any suitable form including a hydraulic, electric, or pneumatic actuator. While the actuator 40 has been shown as a linear actuator, a rotary actuator is equally suitable. If desired, the control arm 38 can function as a manually controlled handle by which an operator moves the control arm 38 to a selected position or, optionally, the control arm 38 can be operated remotely by a "Bowden" type cable or other mechanical linkage.

When the control arm 38 is in its first position as shown in FIG. 2, the debris-intake hood 22 is configured in its normal debris removal mode in which a high-volume, high-velocity flow of air enters the air-inlet structure 34 and moves laterally from the right to the left in FIG. 2 to exit the debris-intake hood 22 through the air-flow outlet 36 as shown by the solid and dotted-line arrows.

When the control arm 38 is in its second position as shown in FIG. 3, the debris-intake hood 22 is configured in its air blast/blower mode in which a high-volume, high-velocity flow of air enters the air-inlet structure 34 and is directed laterally outward of the debris-intake hood 22 to the right in FIG. 3. The high-volume, high-velocity flow of air through the debris-intake hood 22 entrains or otherwise picks-up debris from the roadway surface as is known in the art.

Figure 4:
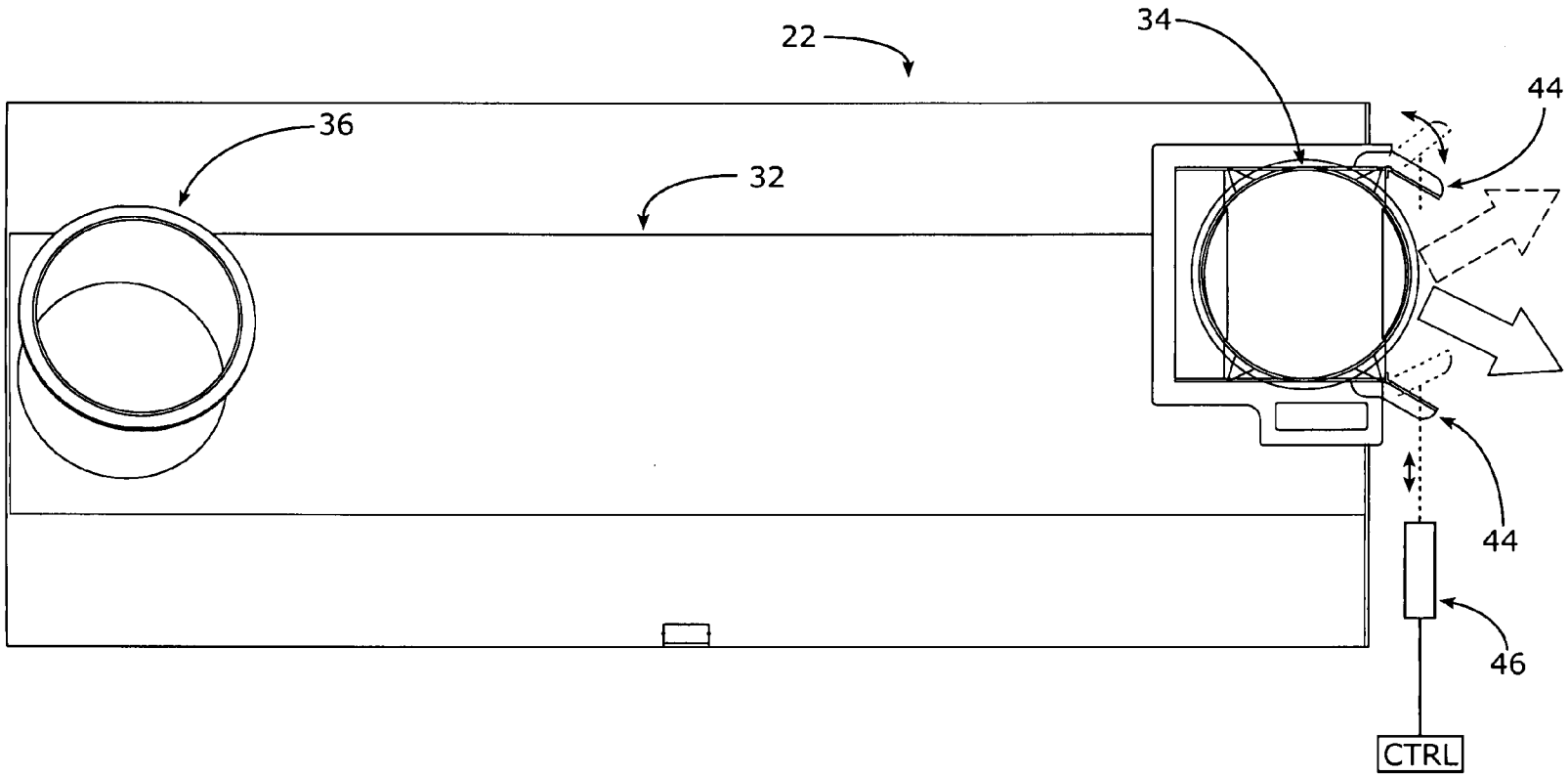
FIG. 4 is a top view of the debris-intake hood of FIGS. 2 and 3.

FIG. 4 is a top view of the debris-intake hood 22 and illustrates the air-flow inlet structure 34 and the air-flow outlet 36 of FIGS. 2 and 3 from the top. As shown on the right in FIG. 4, one or more air-directing vanes 44 can be optionally provided to direct the air blast in the direction shown. In the preferred embodiment, the air-directing vanes 44 are fixed to the air-flow inlet structure 34 and direct the air blast laterally and fowardly from the vehicle. As can be appreciated and as shown in FIG. 4 in dotted-line illustration, the air-directing vanes 44 can be pivotally mounted on appropriate hinges (or similar structure) and connected together by a link (not shown) so that they move together. A bi-directional actuator 46 is attached to one or the other of the vanes 44 and selectively controlled to point the air blast in a desired direction. If desired, the actuator 46 can be controlled in a cyclic or oscillatory manner by an appropriate controller to cause the air blast to sweep in a recurring manner to and from its angular limits. As in the case of the actuator 40, the actuator 46 can take any suitable form including a linear or rotary hydraulic, electric, or pneumatic actuator or mechanical actuator such as a "Bowden" cable or other suitable linkage.

FIGS. 4A-4D represent further alternate variants of the present invention including independent control of the air-directing vanes 44 and further air-directing vanes that allow an up/down control of the air blast.

Figure 4A:
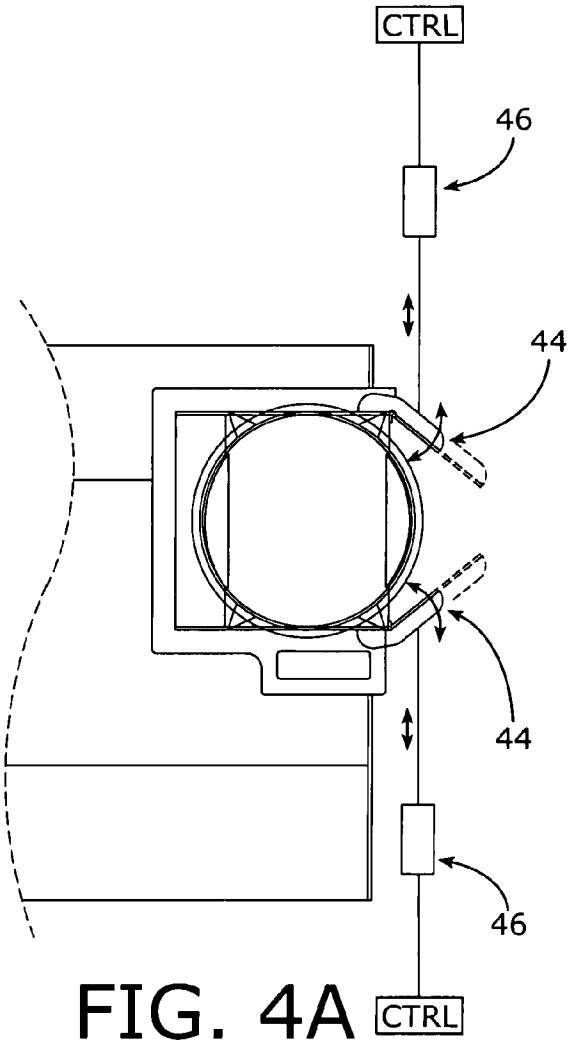
FIGS. 4A and 4B illustrate an alternate variant of the structure shown in FIG. 4.
Figure 4B:
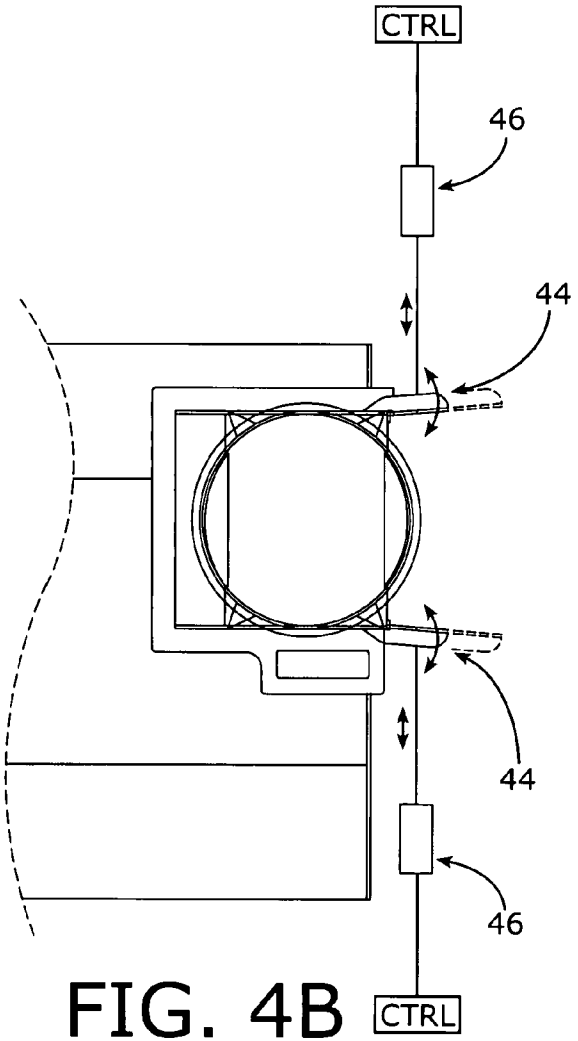

In FIG. 4A, each air-directing vane 44 is under independent control of a respective actuator 46 so that each air-directing vane 44 can be independently moved. As shown in FIG. 4A, the air-directing vanes 44 can be pivoted toward one another to "narrow" the air flow or, as a shown in FIG. 4B, the air-directing vanes 44 can be pivoted away from one another to "widen" the air flow. While FIGS. 4A and 4B show their respective air flows as laterally directed, the air-directing vanes 44 can be controlled to direct the appropriately "narrowed" or "widened" air flow in a forward or aft direction as desired and in a manner consistent with that shown in FIG. 4.

Figure 4C:
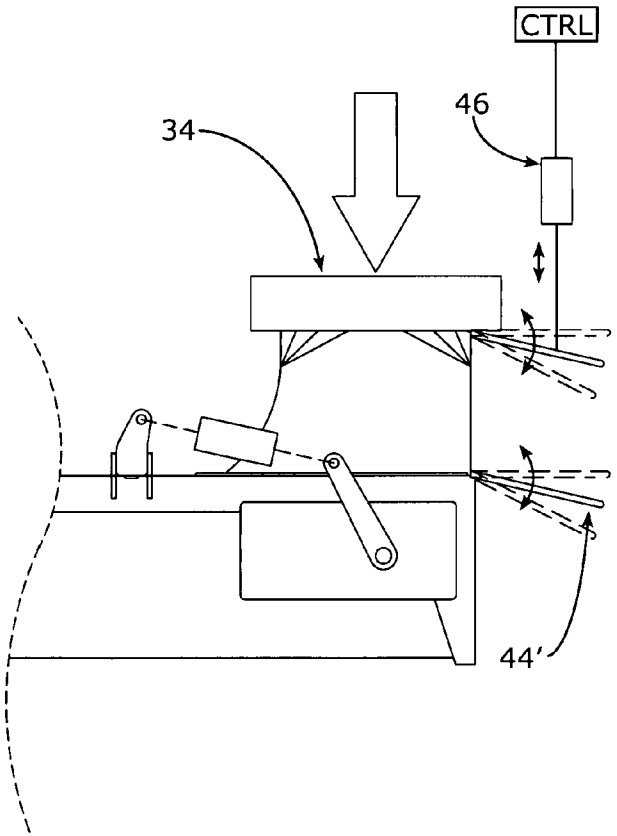
FIGS. 4C and 4D illustrate further alternate variants of the structure shown in FIG. 4.

FIG. 4C shows an embodiment in which the air-control vanes 44 described above are removed and replaced by spaced-apart air-control vanes 44' that are pivoted or hinged along axes that are 90° relative to those of the air-control vanes 44 of FIG. 4. The air-control vanes 44' are connected by a link (not shown) so that they move together under the control of an actuator 46 so that the air flow can be directed down toward the ground surface, horizontally relative to the ground surface, or upwardly. As in the case of the embodiments of FIGS. 4A and 4B, the air-control vanes 44' can be independently controlled by separate actuators 46 to "narrow" or "widen" the air flow as desired while also allowing for up/down directional control.

Figure 4D:
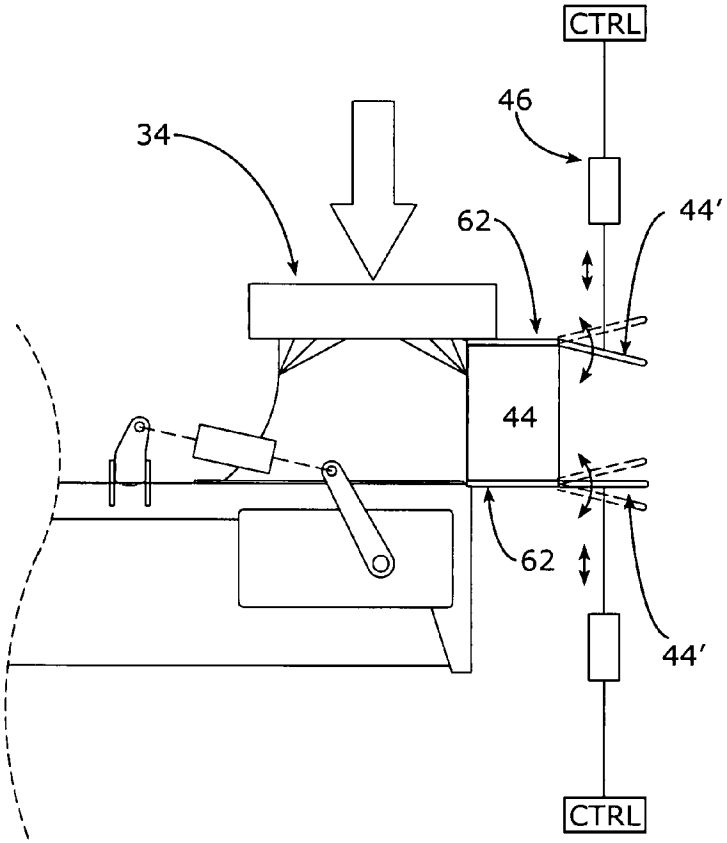

The embodiment of FIG. 4D represents a combination of controllable vanes 44 for forward/aft direction control and vanes 44' for up/down direction control. In FIG. 4D, the air-control vanes 44 are shown as rectangular panels and are mounted in the same manner as in FIG. 4 and FIG. 4A or FIG. 4B with one or more actuators providing directional control. Baffle plates 62 are affixed to the air-inlet structure 34 and extend outwardly therefrom with sufficient clearance so that the air-control vanes 44 are free to move to control the forward/aft direction of the air blast. In addition, air-control vanes 44' are pivoted to or hinged to the remote ends of the baffle plates 62 and are controlled by one or more actuators to provide up/down directional control. As can be appreciated, the embodiment of FIG. 4D provides the operator with the ability to control the forward/aft and the up/down direction of an appropriately "narrowed" or "widened" air blast to effect the desired debris removal or movement solution.

FIGS. 5-9 illustrate the operation of an air-flow controller 48 located in the air-flow inlet structure 34. In FIG. 5, an air-flow controller 48 is shown in its air-blast position corresponding to FIG. 3 in which a high-volume, high-velocity air flow enters the air-flow inlet structure 34 and is directed by the air-flow controller 48 through an opening 50 (FIG. 6) with the air-flow directing vanes 44 assisting in the control of the resulting air blast. In FIG. 7, the air-flow controller 48 is shown in an intermediate position as it is moved to its first position corresponding to FIG. 2. In FIG. 8, the air-flow controller 48 is shown in its first position in which the air flow entering the air-flow inlet structure 34 is directed by interval vanes (not shown) into the debris-intake hood 24 as shown in FIG. 2 while the opening 50 is concurrently and substantially blocked or occluded.

Figure 9:
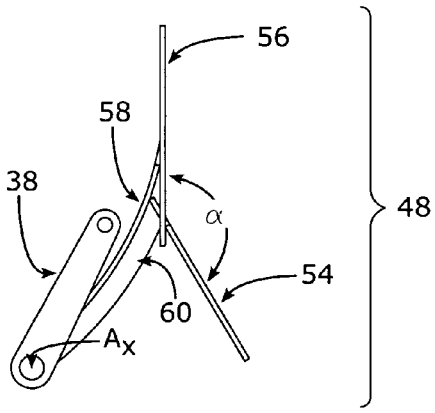
FIG. 9 is a side elevational view of the air flow control structure.
Figure 10:
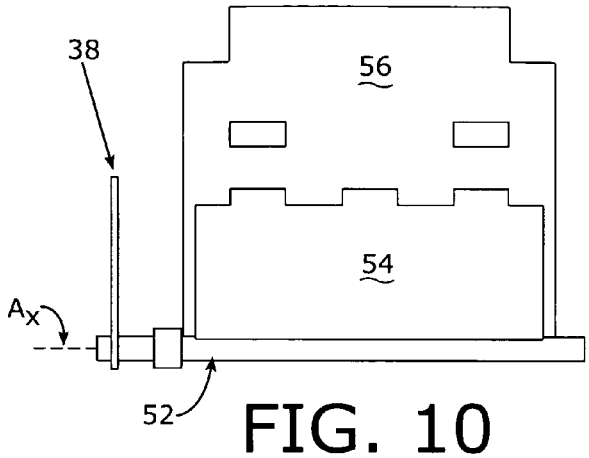
FIG. 10 is a front elevational view of the air flow control structure of FIG. 9.

The structure of the air-flow controller 48 is shown in FIGS. 9-12; as shown in the side view of FIG. 9 and the elevational view of FIG. 10, the air-flow controller 48 includes the above-mentioned control arm 38 attached at its one end to a shaft 52 mounted for limited rotation about the axis $A_x$. A multi-plate assembly that includes first, second, and third sub-plates 54, 56, and 58 and a brace 60 are mounted to the shaft 52 (e.g., by welding) for rotation therewith in response to movement of the control arm 38.

Figure 11:
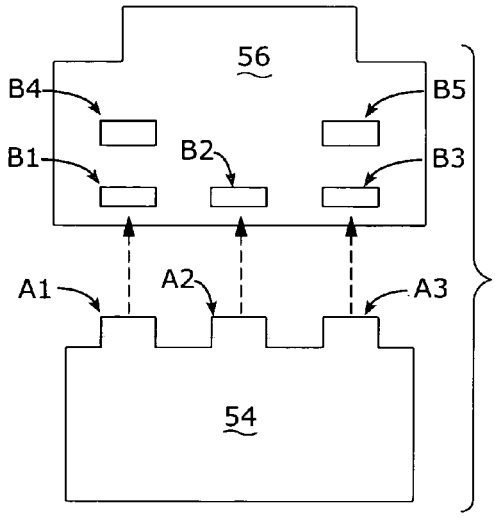
FIG. 11 illustrates the manner by which the air flow control structure of FIG. 10 is fabricated.
Figure 12:
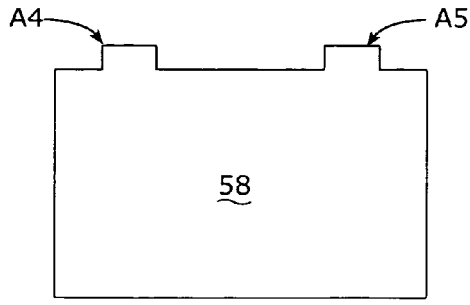
FIG. 12 is a front elevational view of a support panel for the air flow control structure of FIG. 9.

As shown in FIG. 11, the sub-plates 54 and 56 are assembled as a tab-and-slot weldment; more specifically, tabs A1, A2, and A3 in the sub-plate 54 are received in appropriately sized and positioned slots B1, B2, and B3 in the sub-plate 56 and secured together with the sub-plates 54 and 56 aligned at an angle α (i.e., about 150°) as shown in FIG. 9. The sub-plate 58 includes tabs A4 and A5 that interengage with slots B4 and B5 in the sub-plate 56 as shown in FIG. 9. Preferably, the sub-plate 58 is formed along a curved line that corresponds to internal flow vanes (not shown) in the housing 32 of the debris-intake hood 22 to smoothly transition the high-velocity, high-volume air flow into and through the debris-intake hood 22. For the preferred embodiment shown, the general angular separation between the sub-plate 54 and that of the sub-plate 58 can be in the general vicinity of about 70° or so.

When the control arm 38 is in its first position as shown in FIG. 2, the sub-plate 56 substantially blocks or occludes the opening 50 (FIG. 6) with the various margins of the sub-plate 56 engaging with or otherwise pressing against margins of the opening 50 to form an adequate seal therebetween. In this configuration, the high-velocity, high-volume air flow entering the air-inlet structure 34 is guided, in part, by the appropriately curved sub-plate 58 into the interior of the housing 32 and moves laterally from the right to the left in FIG. 2 to exit the debris-intake hood 22 through the air-flow outlet 36 as shown by the solid and dotted-line arrows in FIG. 2.

When the control arm 38 is in its second position as shown in FIG. 3, the debris-intake hood 22 is configured in its air blast/blower mode in which a high-volume, high-velocity flow of air enters the air-inlet structure 34 and is directed laterally outward of the debris-intake hood 22 through the opening 50 to the right in FIG. 3. In this air blast mode, the sub-plates 54 and 56 engage or otherwise press against interior surfaces of the air-inlet structure 34 to direct the high-volume, high velocity air flow through the opening 50 with the air-directing vanes 44 directing or guiding the air blast. In the case of the preferred embodiment, the air-inlet structure 34 is located on the driver side of the vehicle 20 and the air-directing vanes 44 (and/or 44') are oriented or aligned to direct the air blast laterally of the vehicle. As can be appreciated and as mentioned above, the air-directing vanes 44 can be made adjustable as desired.

Figure 13:
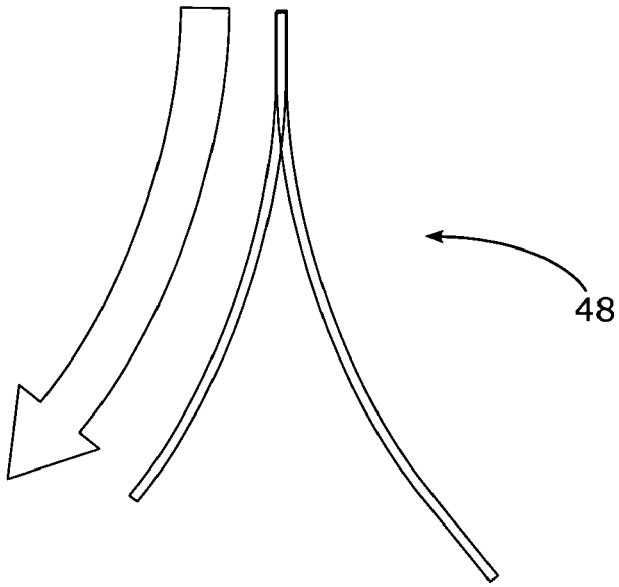
FIGS. 13 and 14 are an idealized view of a curvilinear air flow control structure.
Figure 14:
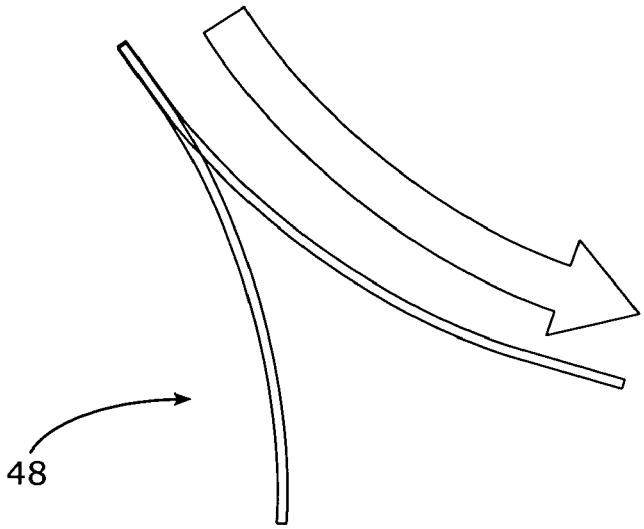

In the exemplary embodiment above, the air-flow controller 48 has been shown as a multi-plate weldment; as can be appreciated, other embodiments are possible. For example and as shown diagrammatically in FIGS. 13 and 14, another air-flow controller 48' is shown as an appropriately shaped single curvilinear plate or as a multi-plate weldment that is appropriately shaped to provide the desire operation. As can be appreciated, the air-inlet structure 34 is appropriately modified to accommodated the air-flow controller 48'. In yet another variation, a single sub-plate can be welded to the shaft 52 to function as a simple 'flap' valve in which the shaft 52 is rotated to substantially block the opening 50 or counter-rotated to substantially block the interior cross-section of the air-inlet structure 34 while unblocking the opening 50.

While the controllers 40 and 46 have been described as any type of linear or rotary hydraulic, electric, or pneumatic actuators, suitable control can also be achieved by manually operable links or linkages, flexible cables, Bowden-type push/pull wires, or combinations thereof. Additionally, the CTRL function shown in FIG. 4 can be a pre-programmable or otherwise programmable electronic or mechanical/electrical device that controls the actuator 46 to move the various air-control vanes 44 and/or 44' in accordance with a desire back-and-forth and/or up/down motion or any other desired sweep pattern.

As will be apparent to those skilled in the art, various changes and modifications may be made to the illustrated embodiment of the present invention without departing from the spirit and scope of the invention as determined in the appended claims and their legal equivalent.

The invention claimed is:

1. A wheeled roadway cleaning vehicle for removing debris from a roadway surface while moving relative to the roadway surface in a forward travel direction, the vehicle having a side-to-side lateral axis and a longitudinal axis, comprising:

an air-flow recirculating system mounted on the vehicle for establishing a recirculating air flow, said air-flow recirculating system including a rotating fan for establishing and directing said recirculating air flow through a debris collection container for collecting debris entrained within said recirculating air flow and including a debris-intake hood extending laterally across the vehicle and carried therebeneath, the debris-intake hood having an open side thereof facing the roadway surface from which debris is to be removed and having an air-inlet structure on one side of the longitudinal axis connected via ducting to said debris collection container and an air-outlet structure on another side of the longitudinal axis through which at least a portion of the recirculating air flow established by said air-flow recirculating system flows, said air-inlet structure having a opening on a side thereof to selectively direct air flow therethrough in a lateral direction away from the vehicle relative to the forward travel direction; and a moveable air-flow control member substantially within said air-inlet structure and movable between a first position to direct the air flow entering said air-inlet structure through the debris-intake hood to said air-outlet structure and at least a second position to block a substantial portion of the air flow from said debris-intake hood and to direct the air flow entering said air-inlet structure through said opening in said air-inlet structure to create an air blast therefrom directed laterally relative to the forward travel direction such that the air blast is directed away from said open side of said debris-intake hood.

2. The pavement cleaning vehicle of claim 1, further comprising means for controlling the direction of the air blast relative the vehicle.

3. The pavement cleaning vehicle of claim 2, wherein the means for controlling the direction of the air blast relative the vehicle includes at least a pair of position-fixed air-control vanes for directing the air blast in selected direction.

4. The pavement cleaning vehicle of claim 2, wherein the means for controlling the direction of the air blast relative the vehicle includes at least a pair of position-adjustable air-control vanes for directing the air blast in selected directions.

5. The pavement cleaning vehicle of claim 4, further comprising means for moving at least one of the pair of position-adjustable air-control vanes to one of a plurality of positions.

6. The pavement cleaning vehicle of claim 4, wherein the means for controlling the direction of the air blast relative the vehicle includes at least a second pair of position-adjustable air-control vanes operable independently of said first-mentioned pair of position-adjustable air-control vanes for directing the air blast in selected directions.

7. The pavement cleaning vehicle of claim 6, further comprising means for moving at least one of the first pair of position-adjustable air-control vanes to one of a plurality of positions and means for moving at least one of the second-mentioned pair of position-adjustable air-control vanes to one of a plurality of positions.

8. A wheeled roadway cleaning vehicle for removing debris from a roadway surface while moving relative to the roadway surface in a forward travel direction, the vehicle having a side-to-side lateral axis and a longitudinal axis, an air-flow recirculating system mounted on the vehicle for establishing a recirculating air flow, said air-flow recirculating system including a rotating fan for establishing and directing said recirculating air flow through a debris collection container for collecting debris entrained within said recirculating air flow and including a pick-up hood extending laterally across the vehicle and carried therebeneath, the pick-up hood and having an open side thereof facing the roadway surface from which debris is to be removed and having an air-inlet structure on one side of the longitudinal axis connected via ducting to said debris collection container to receive the air flow therefrom and an air-outlet structure on another side of the longitudinal axis through which at least a portion of the recirculating air flow established by said air-flow recirculating system flows, said air-inlet structure having a opening on a side thereof to selectively direct air flow therethrough in a lateral direction away from the vehicle relative to the forward travel direction and an air-flow control vane substantially within the air-inlet of the pick-up hood for selectively directing the recirculating air-flow into the pick-up hood or for selectively blocking a substantial portion of the air flow from said pick-up hood and concurrently directing a substantial portion of the recirculating air-flow through said opening in the air-inlet to create an air blast therefrom directed laterally relative to the forward travel direction.

9. The roadway cleaning vehicle of claim 8, further comprising first and second fixed-position air-flow control vanes to control the direction of the air blast.

10. The roadway cleaning vehicle of claim 8, further comprising first and second variable-position air-flow control vanes for selectively controlling the direction of the air blast.

11. The roadway cleaning vehicle of claim 8, wherein the air-flow control structure includes a least a moveably mounted plate moveable between a first position in which a substantial portion of the recirculating air flow is passed into the pick-up head and a second position in which a substantial portion of the recirculating air flow is passed through said opening to create said air blast.

12. The roadway cleaning vehicle of claim 11, further comprising a selectively controllable actuator connected to said plate to effect movement thereof between said first and second positions.

* * * * *